United States Patent [19]

Stoutenberg

[11] Patent Number: 4,621,425

[45] Date of Patent: Nov. 11, 1986

[54] RETRACTABLE KNIFE HANDLE

[75] Inventor: Carl C. Stoutenberg, Burlington, Conn.

[73] Assignee: Stanley Works, New Britain, Conn.

[21] Appl. No.: 658,284

[22] Filed: Oct. 5, 1984

[51] Int. Cl.[4] ..... B26B 3/06

[52] U.S. Cl. ..... 30/162; 30/320; 30/335

[58] Field of Search ..... 30/162, 335, 337, 336, 30/320

[56] References Cited

U.S. PATENT DOCUMENTS

| | | | |
|---|---|---|---|
| 1,574,665 | 9/1925 | Lovin . | |
| 2,605,545 | 4/1948 | Weems | 30/337 |
| 2,651,108 | 7/1947 | Weems | 30/337 |
| 3,085,332 | 4/1961 | Raybin | 30/339 |
| 3,107,426 | 10/1963 | Robinson, Jr. | 30/162 |
| 3,171,201 | 3/1965 | Carifi | 30/335 |
| 3,660,895 | 5/1972 | West | 30/162 |
| 3,855,700 | 12/1974 | Gerson et al. | 30/162 |
| 3,857,176 | 12/1974 | Quenot | 30/162 |
| 3,863,339 | 2/1975 | Reaney et al. | 30/162 |
| 3,889,368 | 6/1975 | Himeno | 30/162 |
| 3,906,626 | 9/1975 | Riuli | 30/162 |
| 4,005,525 | 2/1977 | Gringer | 30/125 |
| 4,089,112 | 5/1978 | Richards | 30/162 |
| 4,103,421 | 8/1978 | Quenot | 30/162 |
| 4,196,515 | 4/1980 | Sugiyama | 30/162 |
| 4,232,445 | 11/1980 | Ito | 30/162 |
| 4,277,888 | 7/1981 | Szabo | 30/162 |
| 4,292,738 | 10/1981 | Osada | 30/162 |
| 4,509,260 | 4/1985 | Gringer | 30/162 |

*Primary Examiner*—E. R. Kazenske
*Assistant Examiner*—Willmon Fridie, Jr.
*Attorney, Agent, or Firm*—Prutzman, Kalb, Chilton & Alix

[57] ABSTRACT

A retractable knife handle employs a blade carrier mounting a blade for longitudinally moving the blade between retracted sheathed and extended unsheathed positions. A leaf spring extends from the blade carrier to engage an inwardly projecting cam surface so that when the blade carrier is shifted to the extended unsheathed position, the blade is clamped between the blade carrier and case.

12 Claims, 4 Drawing Figures

RETRACTABLE KNIFE HANDLE

BACKGROUND OF THE INVENTION

This invention relates generally to retractable knife handles adaptable for mounting a replaceable blade. More particularly, this invention relates to a knife handle for a utility knife employing blade which may be slidably moved from a sheathed position wherein the blade is enclosed within the handle to an extended unsheathed position wherein the knife blade projects through an opening in the handle to present a cutting edge.

An exemplary type of knife handle to which the present invention is particularly related is diclosed in U.S. Pat. No. 3,107,426 issued to W. H. Robinson, Jr. on Oct. 22, 1963 and entitled "Utility Knife." Such a utility knife incorporates a blade carrier which mounts and supports the blade at the interior of the handle for longitudinal movement therein. The blade carrier incorporates a thumb actuated button that can be depressed to unlatch the blade from one of several latched positions for shifting the blade via the blade carrier to another longitudinal position. The thumb actuated button extends through a slot in the top of the knife handle and is secured to the blade carrier by means of a resilient finger. The knife handle is further adapted so that the blade may be relatively easily dismounted and replaced. Such knives have found great popularity and are of a great utility in a wide variety of cutting operations.

While the foregoing utility knives are relatively inexpensive to manufacture and generally operate in an efficient and safe manner, a common problem of such retractable knives is a loose or rattling blade condition. The mounted blades often tend to exhibit side wobble characteristics when the blades are advanced to the extended unsheathed position—especially when the blade is subjected to cutting stresses. The looseness or side wobble of the blade frequently detracts from the many positive characteristics of retractable utility knives. The present invention is specifically directed to eliminating the loosenes and side wobble in retractable utility knives.

BRIEF SUMMARY OF THE INVENTION

Briefly stated, the invention in a preferred form is a retractable knife handle which includes an elongated case having a forward blade opening. A blade carrier is slidably mounted in the case and is adapted for removeably mounting a blade. The blade carrier is selectively longitudinally moveable in the case between a retracted sheathed position and an extended unsheathed position wherein the mounted blade extends through the blade opening to present a cutting edge. A leaf spring extends from the blade carrier to selectively urge the blade carrier toward a mounted blade. A projection in the form of a ramp-like structure at the interior of the case interiorly extends to engage the leaf spring when the blade carrier is in the unsheathed position so that the leaf spring biases the blade carrier into a clamping engagement wherein the mounted blade is clamped between the carrier and an interior side of the case.

The blade carrier preferably includes a generally upright planar blade support and the leaf spring is integral with the planar blade support and extends at an acute angle therefrom. The case includes a pair of spaced carrier guides which receive the blade carrier for longitudinal movement therealong. The projection includes a cam surface which is located between the carrier guides and aligns with the leaf spring.

An object of the invention is to provide a new and improved retractable knife handle adaptable for mounting a replaceable blade.

Another object of the invention is to provide a new and improved retractable knife handle which eliminates side wobble when the blade is extended to the unsheathed cutting position.

A further object of the invention is to provide a new and improved retractable knife handle which exhibits improved blade tightening characteristics and which is relatively inexpensive to manufacture.

Other objects and advantages of the invention will become apparent from the specification and the drawing.

DETAILED DESCRIPTION OF THE DRAWING

DETAILED DESCRIPTION OF THE INVENTION

Figure 1:
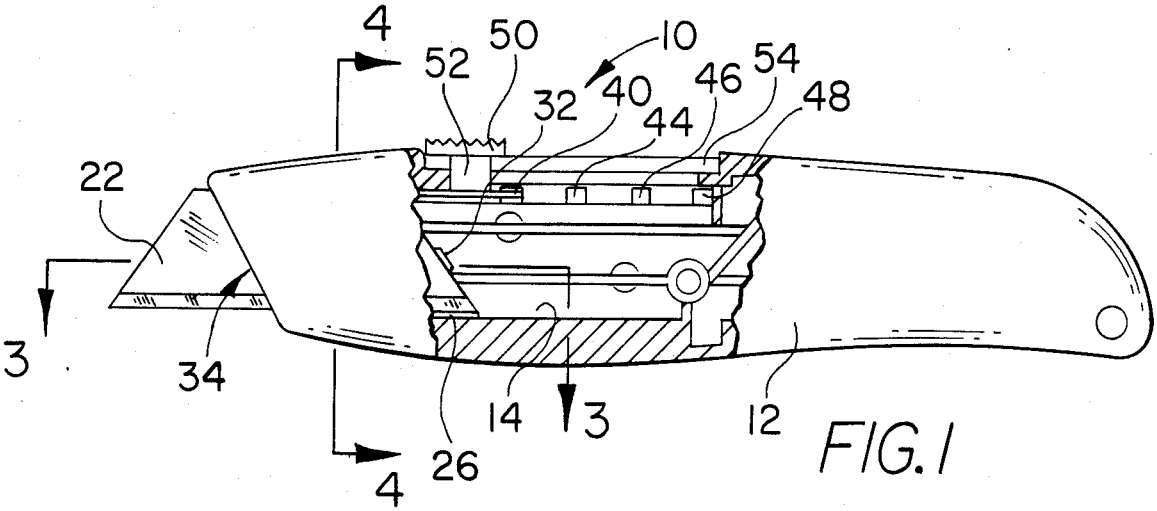
FIG. 1 is a side-elevational view of the retractable knife handle of the present invention, partly broken away and partly in section, illustrating a mounted blade in the extended position.

With reference to the drawing wherein like numerals represent like parts throughout the several figures, a retractable knife handle in accordance with the present invention is generally designated by the numeral 10. Knife handle 10 comprises a pair of mating case sections 12 and 14 which are assembled to form a hollow interior and an exterior which is contoured to facilitate grasping of the handle. Case section 14 interiorly forms equidistantly spaced guideways 16 and 18 for slidably mounting a generally planar blade carrier 20 for linear longitudinal movement interior of the case sections.

A removeably replaceable blade 22 is mounted in fixed position to the blade carrier 20. Blade carrier 20 includes a generally upright planar blade support 38. A flange 24 extends from the top of the blade support 38 toward the opposite case section 12. A second flange 26 extends from the bottom of the blade support toward the opposite case section 12. Blade 22 engages against planar support 38 and is retained between flanges 24 and 26 of the blade carrier for generally vertical retention. Blade 22, which is preferably of a trapezoidal form, is retained in a fixed longitudinal position to the blade carrier by a tab 28 which engages a notch (not illustrated) at the top of the blade and by a rearward retention tab 32 which engages a rear noncutting edge of the blade. Flanges 24 and 26 are also adapted for reception in guideways 16 and 18, respectively, for sliding movement therealong. A pair of spaced longitudinally extending channels 17 and 19 are interiorly formed in case section 12 for accommodating the inwardly extending flanges 24 and 26, respectively. The channels 17 and 19 are defined by a pair of spaced longitudinally extending retention ribs 21 and 23 which extend from the interior side of case section 12. The retention ribs 21 and 23 cooperate with the blade support to laterally retain the intermediately positioned blade 22.

Figure 2:
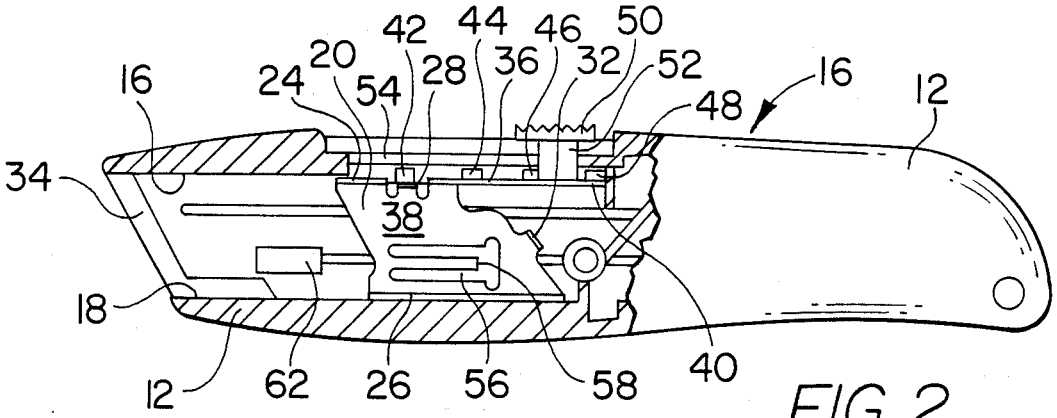
FIG. 2 is a side-elevational view of the knife handle of FIG. 1, partly broken away and partly in section, illustrating the handle in a retracted position with the knife blade dismounted.

The case sections cooperate to form a forward blade opening 34 so that the blade 22 may be longitudinally moved by the blade carrier to an extended unsheathed position wherein the cutting edge of the blade extends through the opening 34 to present a cutting edge as illustrated in FIG. 1. The blade carrier may be retracted to a sheathed position such as shown in FIG. 2 wherein the blade (not illustrated in FIG. 2) is entirely enclosed by the case sections. Excepting for the modifications described herein, knife handle 10 may be similar in form and function to that described in U.S. Pat. No. 3,107,426.

An integral resilient finger 36 extends rearwardly of the planar blade support 38. Finger 36 rearwardly forms a pair of oppositely projecting latching tabs 40 which are adapted to be received in any one of notches 42, 44, 46, and 48 to latch the blade carrier and hence to position the mounted blade in a selected sheathed or unsheathed longitudinal position. The notches are formed in the top interior of the case sections 12 and 14. In the knife handle illustrated in the drawing, the reception of tabs 40 in slots 42, 44, and 46 define three unsheathed or cutting positions of blade 22. A thumb button 50 is connected to the resilient finger 36 by a neck 52 which extends upwardly through a longitudinal slot 54 formed in the top of the knife handle. The blade carrier 20 may be manually longitudinally adjusted by pressing the thumb button 50 to unlatch the latching tab 40 and shifting the blade carrier longitudinally with respect to the handle.

With reference to FIG. 2, the blade carrier 20 is preferably an integral structure formed from a sheet of metal such as steel by a process wherein the steel sheet is cut and then bent to form the foregoing described flanges 24 and 26, tabs 28 and 32, and finger 36 which extend from the planar blade support 38. The generally upstanding planar blade support 38 has an intermediate cutout 56 for forming an intermediate longitudinally extending integral leaf spring 58. Leaf spring 58 is formed by bending the intermediate strip of metal formed by cutout 56 at an acute angle away from the planar blade support surface which contacts against the mounted blade. A projection 60 in the form of a ramp-like structure protrudes interiorly from the interior side of case section 14 at a forward portion thereof. Projection 60 is located generally between guideways 16 and 18 and generally vertically aligns with leaf spring 58. Projection 60 forms a cam surface 62 which is adapted for biasing engagement with the exterior surface of leaf spring 58.

Figure 4:
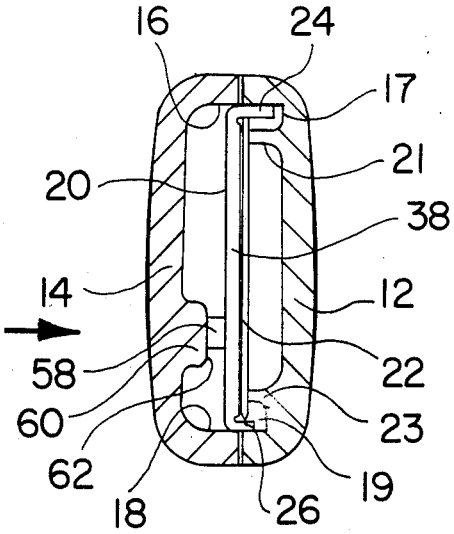
FIG. 4 is a sectional view of the retractable knife handle taken along the line 4—4 of FIG. 1.

As a mounted blade 22 is longitudinally moved by shifting carrier 20 from a retracted sheathed position to an extended unsheathed position, the outwardly biased leaf spring 58 of the blade carrier engages projection 60 with the outer surface of the leaf spring riding over cam surface 62. In the illustrated embodiment, cam surface 62 projects interiorly into the cavity of the case a sufficient distance so that when the carrier 20 is in the extreme extended position (tabs 40 being received in slot 42), the fixed cam surface 62 engageably depresses the resilient leaf spring 58 toward the planar blade support 38 of the carrier. Consequently, the resilience of leaf spring 58 urges the planar blade support 38 to a forceful clamping engagement against blade 22 in the general direction of the arrow of FIG. 4. The side of blade 22 which is opposite the side which engages the blade support 38 engages retention ribs 21 and 23 to limit the side o lateral movement of the blade. The channels 17 and 19 are laterally dimensioned to accommodate the laterally extending flanges 24 and 26, respectively, of the laterally biased blade carrier as illustrated in FIG. 4. Thus, in the extended position, the leaf spring 58 and projection 60 cooperate to urge the carrier into a clamping engagement with the blade 22 thereby tightening the blade to eliminate any side wobble of the blade; i.e., movement to the left or right in FIG. 4.

It will be appreciated that as the carrier 20 is advanced to the extended position, the biasing force of the leaf spring acting to effectively urge the carrier into clamping engagement with the blade is gradually increased. Similarly, when the carrier is retracted, the biasing force exerted against the blade carrier is gradually decreased until the leaf spring completely disengages cam surface 62 in a retracted position such as illustrated in FIG. 2 (tabs 40 being received in notch 48). In the extreme extended position, the biasing force of the leaf spring is efficiently distributed across substantially the entire planar blade support 38 so that an efficient clamping engagement of the blade is achieved. The leaf spring and projection are configured and positioned so that they do not otherwise interfere with the efficient retraction and extension of the blade via the blade carrier.

Figure 3:
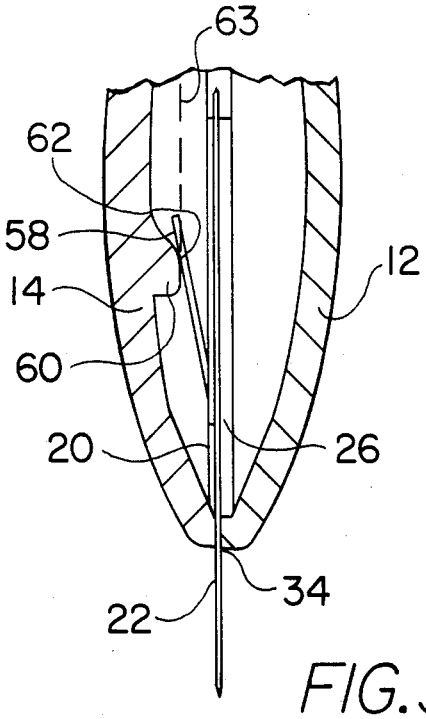
FIG. 3 is sectional view of a portion of the retractable knife handle taken along the line 3—3 of FIG. 1.

In an alternative embodiment of the invention, projection 60 may assume a form having an elongated plateau 63 as illustrated by the dashed lines of FIG. 3 so that the leaf spring bears against the plateau to continuously bias the carrier into clamping engagement with the blade. Thus, the blade is clamped at each of the two intermediate unsheathed positions (defined by notches 44 and 46) as well as the extreme extended position (defined by notch 42). In the sheathed retracted position (defined by notch 48), the leaf spring is disengaged from the plateau as previously described.

While a preferred embodiment of the invention has been set forth for purposes of illustration, the foregoing description should not be deemed a limitation of the invention herein. Accordingly, various modifications, adaptations, and alternatives may occur to one skilled in the art without departing from the spirit and scope of the present invention.

What is claimed is:

1. A retractable knife comprising:

an elongated case having a forward blade opening;

a blade carrier slideably mounted in said case;

a blade removeably mounted to said carrier;

said blade carrier being selectively longitudinally moveable in said case between a retracted sheathed position and an extended unsheathed position wherein the mounted blade extends through said blade opening to present a cutting edge;

biasing means extending from said blade carrier to selectively urge the blade carrier against said mounted blade; and engagement means at the interior of said case for selective engagement by said biasing means so that the engagement means bears upon the biasing means when the blade carrier is in the extended position, the biasing means thereby urging the blade carrier into a clamping engagement wherein the mounted blade is clamped between the carrier and the case, and when the carrier is in the retracted position, the clamping engagement is released.

2. The retractable knife of claim 1 wherein the biasing means is a leaf spring.

3. The retractable knife of claim 2 wherein the engagement means comprises a longitudinally extending ramp-like structure which projects inwardly from the case and generally aligns with the leaf spring.

4. The retractable knife of claim 1 wherein the blade carrier includes a planar blade supporting portion and the biasing means is a leaf spring integral with said planar portion and extending at an acute angle therefrom.

5. The retractable knife of claim 4 wherein the case includes at the interior a pair of spaced carrier guides which receive the blade carrier for longitudinal movement therealong and said engagement means includes a cam surface located between said carrier guides and aligned with said leaf spring.

6. The retractable knife of claim 4 wherein the blade carrier further includes integral flange portions extending from said planar portion and adapted for securing a mounted blade in fixed position to said carrier.

7. A retractable knife handle comprising:

an elongated case having a forward blade opening;

a blade carrier slidably mounted in said case and including a blade supporting portion and a flange means adaptable for retainably mounting a blade, said blade carrier being selectively longitudinally movable in said case between a retracted position and an extended position wherein a mounted blade extends through said blade opening to present a cutting edge;

a leaf spring extending from said blade carrier;

an engagement surface at the interior of said case and aligned with said leaf spring so that when the blade carrier is in the extended position, the leaf spring bears against the engagement surface thereby urging the supporting portion of the carrier toward an interior side of the case, and when said blade carrier is in the retracted position, said leaf spring disengages from the engagement surface.

8. The knife handle of claim 7 wherein the supporting portion is substantially planar and the leaf spring is an integral resilient elongated member normally extending rearwardly at an acute angle to the planar supporting portion from an intermediate location thereof.

9. The knife handle of claim 8 wherein the engagement surface is a cam surface projecting from an interior side of the case.

10. A retractable knife comprising:

an elongated case having a forward blade opening and interiorly forming a pair of spaced guide means;

a blade carrier slidably received in said guide means, said blade carrier mounting a blade and including a blade supporting portion and a flange means to removably retain said blade, said blade carrier being selectively longitudinally movable along said guide means between a retracted sheath position and an extended unsheathed position wherein said blade extends through said blade opening to present a cutting edge;

biasing means extending from said blade carrier;

engagement means positioned at the interior of said case for engagement by said biasing means so that the engagement means bears upon the biasing means when the blade carrier is in the extended position, and the blade is clamped between the blade supporting portion and the interior of the case by the force of the biasing means.

11. The knife of claim 10 wherein the biasing means is a leaf spring integral with said carrier, said leaf spring extending rearwardly normally at an acute angle from the blade supporting portion.

12. The knife of claim 11 wherein the engagement means comprises a ramp-like structure having a cam surface aligned with said leaf spring so that as the carrier is moved to the extended position, the leaf spring rides the structure to engage the cam surface, and as the carrier is moved to the retracted position, the leaf spring disengages the cam surface.

* * * * *